United States Patent [19]

Zich

[11] Patent Number: 5,013,100

[45] Date of Patent: May 7, 1991

[54] MULTI-PART SHELF

[76] Inventor: Bernhard Zich, Oskar-Sommer-Str. 20, D-6000 Frankfurt/Main 70, Fed. Rep. of Germany

[21] Appl. No.: 443,160

[22] Filed: Nov. 30, 1989

[30] Foreign Application Priority Data

Dec. 3, 1988 [DE] Fed. Rep. of Germany ... 8815057[U]
Jan. 19, 1989 [DE] Fed. Rep. of Germany ... 8900642[U]
Jul. 15, 1989 [DE] Fed. Rep. of Germany ..... 3923452

[51] Int. Cl.[5] ..... A47B 87/00
[52] U.S. Cl. ..... 312/200; 108/64
[58] Field of Search ..... 312/324, 248, 249, 250, 312/251, 200, 199, 198; 108/41, 64, 114

[56] References Cited

U.S. PATENT DOCUMENTS 1,688,456 10/1928 Dolph ..... 312/197
3,168,781 6/1965 Lax ..... 312/200
3,202,469 8/1965 Lawe .

FOREIGN PATENT DOCUMENTS 2906016 12/1979 Fed. Rep. of Germany ..... 312/198
1059600 11/1953 France ..... 312/324

*Primary Examiner*—Kenneth J. Dorner
*Assistant Examiner*—Gerald A. Anderson
*Attorney, Agent, or Firm*—Larson & Taylor

[57] ABSTRACT

A multi-part shelf includes a unitary middle part and two side parts. All of the parts have a plan outline in the form of an equilateral right triangle, with the outline area of the middle part being twice that of each side part. Each of the parts includes a plurality of superposed triangular shelf floor sections and a plurality of elongate uprights structurally connecting adjacent floor sections at each of the three corners thereof. A respective articulation connection is provided between the middle part and each respective side part for pivotally connecting these parts. The side parts are thus pivotable between a configuration where one cathetus side of the side part is immediately adjacent the hypotenuse side of the middle part and a configuration where the hypotenuse side of the side part is immediately adjacent one cathetus side of the middle part. The floor sections are preferably suspended between adjacent uprights and each upright preferably includes a plurality of elongate segments which are fitted together.

10 Claims, 5 Drawing Sheets

MULTI-PART SHELF

FIELD OF THE INVENTION

The invention relates to a multi-part shelf for use in sales displays, in structures for expositions, in the home and as office furnishing.

BACKGROUND OF THE INVENTION

Shelves are part of the standard equipment of commercial warehousing areas and of private households. They are used for presentation or display of wares or for visible storage and/or preservation of articles of any sort and are commercially available in a number of different embodiments and materials.

The drawback inherent in traditional shelves lies in that their dimensions cannot be modified. The outline, size, dimensions or design of the shelving generally cannot be changed at all or can be modified only slightly by sequential stacking of some plurality of shelves, which are either arranged disengaged but adjacent to one another or are to be screwed together.

SUMMARY OF THE INVENTION

Thus, the object of the invention is to develop a stable and rigid shelf of very simple construction, which allows for esthetically pleasing utilization, and of which the outline of the plan can be adapted to any relevant conditions in any individual case.

The above object is attained according to the invention by a shelf which consists of a middle part and two side parts having in turn an outline or plan in the form of an equilateral right triangle, and the plan view of the surface dimensions of each side part is half the size of the area of the middle part and joint or articulated connections are present between the middle part and the side parts, by means of which the side parts can be swivelled between a position in which they engage with a cathetus (the small side of a right triangle) on the hypotenuse of the middle part and a position in which they engage with the side part hypotenuse on a cathetus of the middle part.

In both of the aforementioned configurations the shelf forms columns with a quadratic or right-angle outline or plan view. The column can be configured in any desired intermediate position between the cited end positions, against a straight wall or in a corner, or it is possible to modify the assembly for conversion or reconstruction of the column arrangement.

The conformity of the outline or plan view and dimensions of the two side parts and then also of half of the middle part simplifies the construction very considerably. Further possibilities of modifications of the shelf, within the range of the different positions of the side parts relative to the middle part, are obtained by modification of the height of the shelf parts. In order to be able to undertake that sort of modification with ease, one further preferred configuration of the invention provides that the shelf be composed of vertical uprights arranged at the corners of the triangular shapes, and of shelf floor sections connected with these uprights, in which the uprights are preferably subdivided into segments which can be stacked and fitted together or can be screwed together, and the segments in turn are configured with one end which can be inserted through apertures in one or two shelf floor sections and with the other end in turn having a support surface for one or two shelf floor sections.

Other features and advantages of the new shelf become obvious from the following description of a plurality of exemplary embodiments described relative to the drawings.

DETAILED DESCRIPTION OF THE PREFERRED EMBODIMENTS

Figure 1:
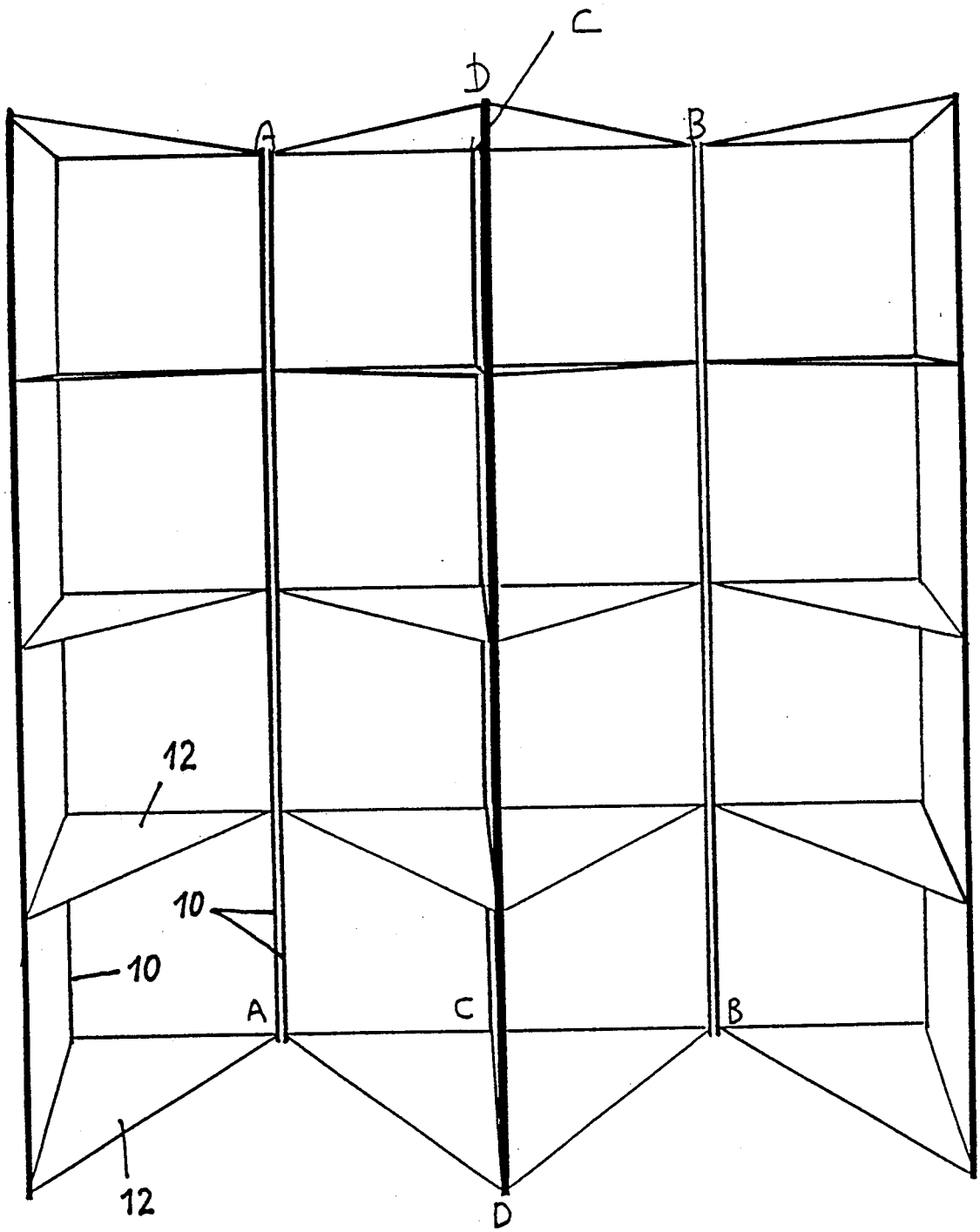
FIG. 1 is a side view of a shelf consisting of three swivellable parts connected with each other in an arrangement as a wall shelf.
Figure 2:
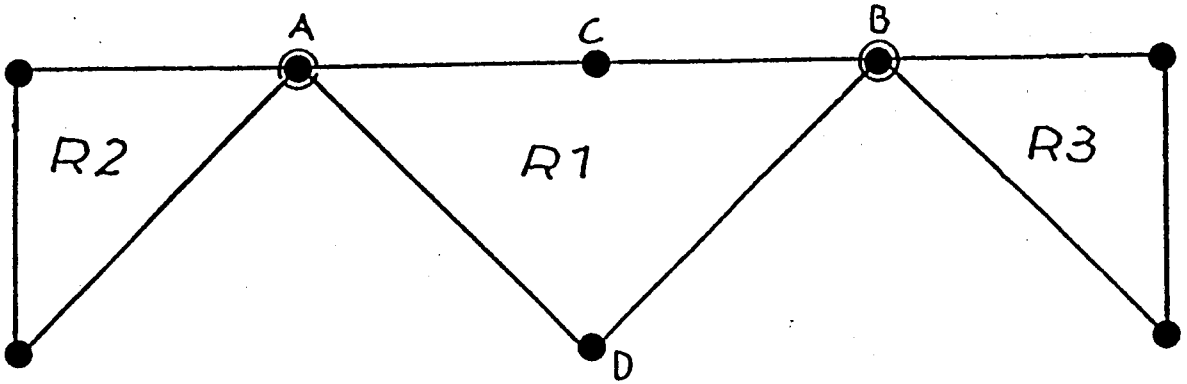
FIG. 2 shows the outline or plan view of the shelf of FIG. 1.

The shelf shown in FIGS. 1 and 2 consists of three parts, including a middle part R1 and side parts R2 and R3 which are connected with one another by articulation. All of the shelf parts as shown in FIG. 2 have right-angle, equilateral base outlines, and the surface of the middle part R1 is dimensionally double the size of the surface of each of the two facing side parts R2 and R3.

In detail, each shelf part R1, R2 and R3 is composed of vertical supports 10 with shelf floor sections which are mounted securely or detachably thereto. In the middle of its hypotenuse at point C, middle part R1 incorporates an additional vertical support or upright 10. In the exemplary embodiment of FIG. 1, on the joint or articulated (pivot) connections A and B, the uprights of middle part R1 which are present there are articulated with the bordering uprights of the side parts R2 and R3.

As shown in FIG. 2, the joint or articulation (pivot) connections A and B are located at the ends of the hypotenuse of middle part R1 and in turn at each end of the hypotenuses of the side parts R2 and R3. Thus the arrangement is such that with coincidental hypotenuses the right-angle corners of the side parts and the middle part are located on opposite sides of the line of coincidental alignment of the hypotenuses. The joint or pivot connections A and B have a sufficiently wide pivot range on the one hand to apply the hypotenuses of the side parts R2 nd R3 against the cathetus of the middle part R1 and on the other hand also to apply a cathetus of the side parts R2 and R3 against the hypotenuse of middle part R1. Between these end positions it would be possible for the side parts R2 and R3 as desired to occupy coincidental and identical or different intermediate positions with relation to the middle part R1. This potential allows for great variability and possibility of adaptation of the shelf while it simultaneously allows for comprehensive rigidity and satisfactory steadiness as a result of the connection of the individual shelf parts R1, R2 and R3.

Figure 3:
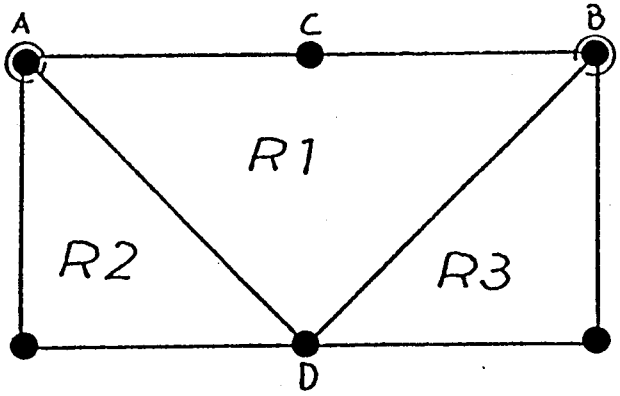
FIG. 3 shows a right-angle plan view of the shelf obtained by the folding out of the side parts on the cathetus of the middle part as in FIGS. 1 and 2, which in this case forms a column.

While FIGS. 1 and 2 show the shelf in a laid-out arrangement with a straight rear wall, to form a wall shelf, FIG. 3 shows a plan view wherein the side parts R2 and R3 are folded out with their hypotenuses against the cathetuses of middle part R1. With the rectangular base which is thus obtained, the shelf forms a column.

Figure 4:
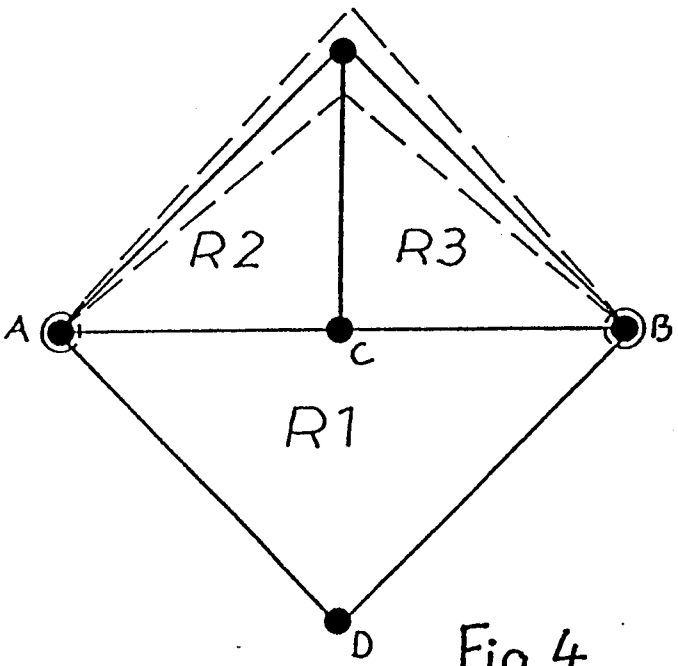
FIG. 4 shows a quadratic outline or plan view of the shelf as in FIGS. 1 and 2, produced by folding out the side parts along the hypotyenuse of the middle part, in which this likewise forms a column.

Proceeding from FIG. 2, the side parts R2 and R3 could also be swivelled to the opposite side, until they engage as shown in FIG. 2 with a cathetus on the hypotenuse of middle part R1. Then the shelf forms a column with quadratic plan view of its base dimensions. As shown in broken lines in FIG. 4, slight deviations of the side parts of the shelf away from the right angle are possible without any negative influence on its function or appearance.

Figure 5:
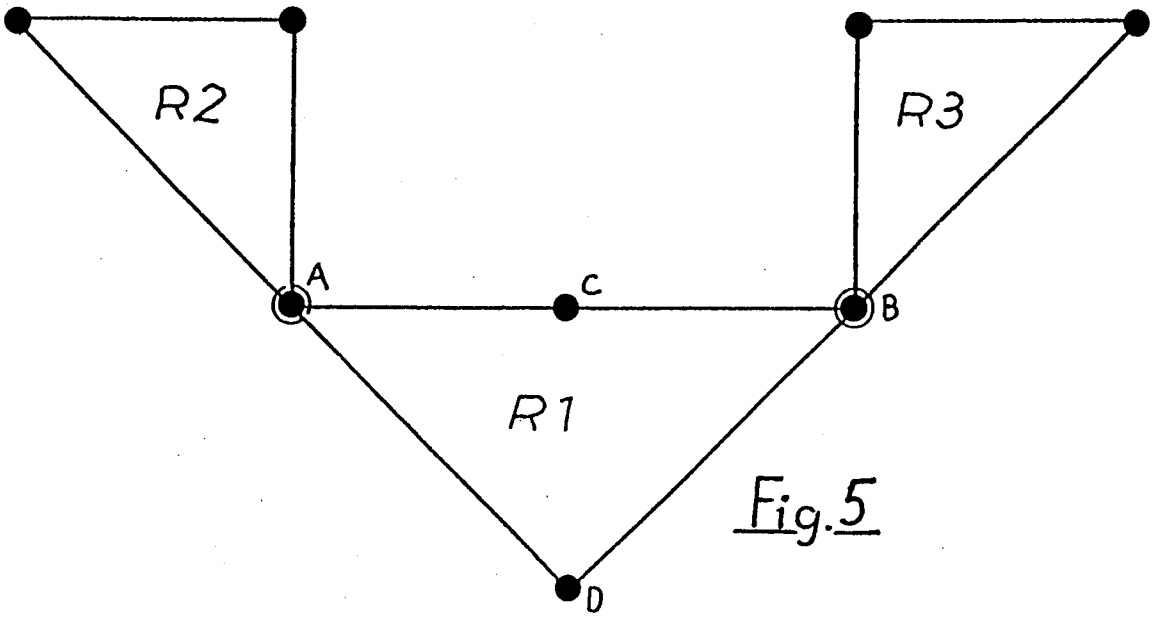
FIG. 5 shows another outline or plan view of the shelf as in FIGS. 1 and 2 in an arrangement as a corner shelf.

FIG. 5 shows the shelf in its plan view in an arrangement in which the hypotenuses of side parts R2 and R3 are in alignment with the cathetuses of middle part R1. In this arrangement, the shelf can be fitted into a corner or, according to the given conditions of a site, can surround or cover a column or a wall salient on three sides. All of these possibilities are available for use of the shelf because the shelf floor sections 12 are fastened in a supporting manner only to the uprights 10 and thus, if the shelf assembly is erected in the middle of a room, the shelves are effortlessly accessible from all sides.

Figures 6, 7, 8:
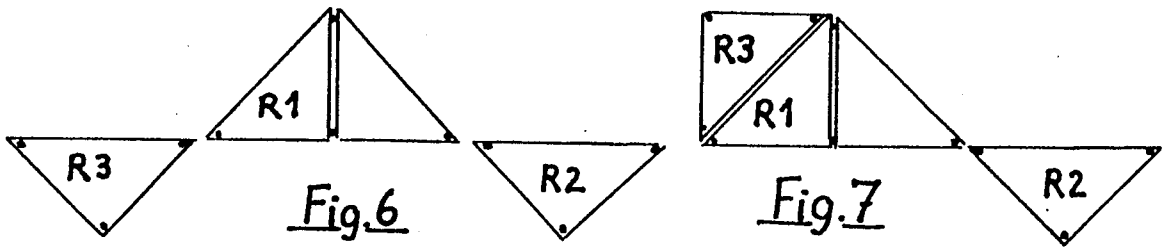
FIG. 6 shows an outline or plan view of the shelf as in FIGS. 1 and 2 in a configuration as a room divider.
FIG. 7 shows another outline or plan view of the shelf in a configuration as a room divider with small column.
FIG. 8 shows another outline or plan view of the shelf in a configuration as a wall shelf with small column.

The shelf is established in just such a manner, out in the room and without support, for instance as a room divider, as shown in FIG. 6. In this case the hypotenuses of side parts R2 and R3 are in alignment with the hypotenuse of middle part R1. Also in this exemplary embodiment, the sectioning of the shelf floor sections of middle part R1 into two triangular halves is represented in this drawing, and the halves are the same size and dimensions as the shelf floor sections of side parts R2 and R3. The shelf floor section halves of middle part R1 are in turn fastened at the outsides of two of their corners to the vertical upright at C in the middle of the hypotenuse. This type of sectioning of the shelf floor sections of middle part R1 is again found in the constructions shown in FIGS. 7–10, wherein two halves of the same size are used.

The plan view of the shelf as shown in FIG. 7, which has been described in various different arrangements, is shown here in an arrangement as room divider with small column. In this case the side part shown on the left is folded out with its hypotenuse against a cathetus of the middle part, while the hypotenuse of the right side part is aligned with the hypotenuse of the middle part. On the other hand, FIG. 8 simply shows the opposite arrangement, in that now a cathetus of the right side part is aligned with the hypotenuse of the middle part. In this configuration the shelf can serve as wall shelf with small column. When the right side part of FIG. 9 is folded out with a cathetus against the hypotenuse of the middle part, then a triangular shelf with column is obtained for other uses, of the type which for instance can be erected in the corner of a wall.

Figures 9, 10:
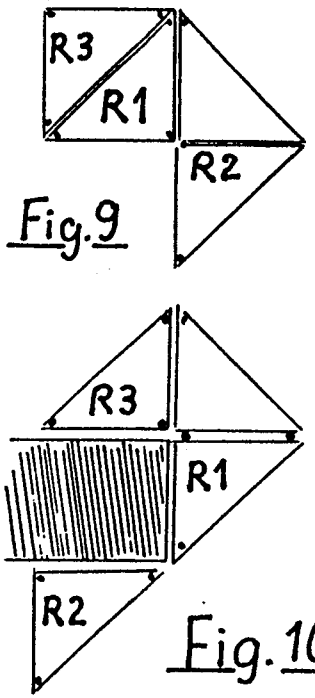
FIG. 9 shows an outline or plan view of the shelf in a configuration as corner shelf with small column.
FIG. 10 shows an outline or plan view of the shelf as the conversion of a column or a wall salient.

Finally, FIG. 10 shows still another relevant configuration of the shelf parts, as can be used for the remodeling or conversion of a column or a wall salient. In this case the hypotenuse of one side part is aligned with a cathetus of the middle part, while the other side part engages with a cathetus on the hypotenuse of the middle part. The free space which is formed between the two side parts is half as wide as the space in the embodiment shown in FIG. 5. Then, according to the dimensions of the column to be converted, it is possible to use one or the other of the two cited embodiments.

Figure 11A:
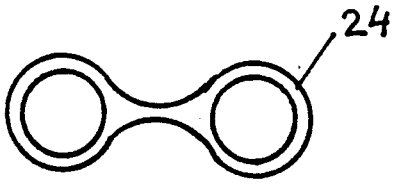
FIG. 11A is an outline or plan view of an insert member which functions with the joint or articulation (pivot) connection of FIG. 11.
Figure 11B:
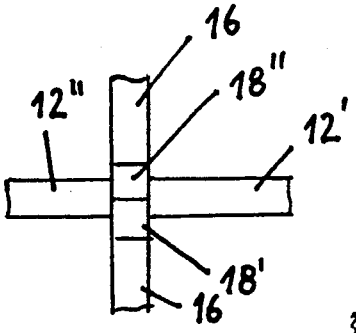
FIG. 11B shows the alternative to FIG. 11 of a joint or articulated (pivot) connection with one single vertical upright.
Figure 11:
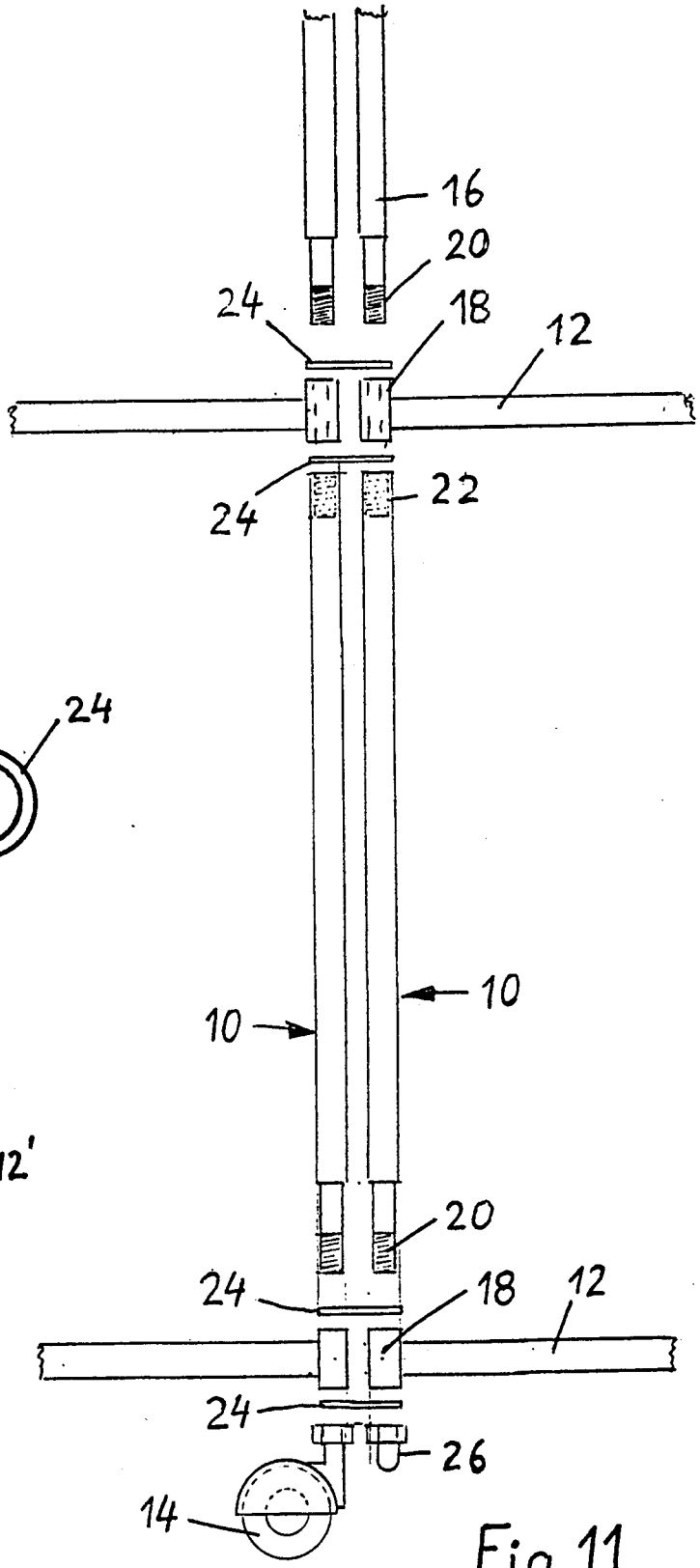
FIG. 11 shows a partial side view of the shelf as in FIGS. 1 and 2 in the area of a joint or articulated connection, in which the separate parts which are connected with one another are shown separated.

FIG. 11 shows one preferred practical embodiment of a shelf which can be disassembled in individual parts. Its uprights 10 are configured in individual segments 16, and several segments 16 can be screwed together by means of outside and inside threads located at their ends to form a long upright 10. Alternatively it could also be provided that the segments be plugged together by plug connections at their ends to form the uprights. The length of the segments corresponds essentially, one observes from the screw engagement, to the vertical intermediate space between the shelf floor sections. Then at each screw coupling or connection point of segments 16 arranged vertically one atop the other is located one shelf floor section 12, fastened detachably at that point. For this purpose, tubular members 18 are securely mounted on the corners of the shelf floor sections, and the inside diameter of tubular member 18 is smaller than the greatest outside diameter of segment 16, but is larger than the diameter of a tapered end 20 of segment 16 which is provided with outside threading. During the assembly, then, a tapered end 20 is inserted through a tubular member 18 of a shelf floor section 12 and is screwed together with an inside thread 22 on the other end of another segment 16, and the axial lengths of the tapered ends 20 and the thread 22 are selected so as to coincide with the length of tubular members 18 so that in the assembled state the shelf floor sections 12 being held axially between two segments 16 have no play or only a very minimal vertical only play.

The relevant adjacent uprights of the shelf parts R1 and R2 or R1 and R3 which border one another are movably connected to the joints A and B of the shelf, said uprights engaging with one another by means of spectacle-like insert members 24 as shown in FIGS. 11 and 11A. It would also be possible in a still simpler embodiment to lay out single and separate rings around the adjacent uprights. In the exemplary embodiment of FIG. 11, an insert 24 of spectacle configuration is inserted above and below tubular member 18 and axially between these members and contact surfaces on the bordering segments 16, and the tapered ends 20 of adjacent segments 16 extend in turn through both of the apertures of each insert member 24 of spectacle configuration.

A pivoting roller 14 is mounted at the bottom end of upright 10 located in the vicinity of a joint or articulation A or B, as in FIG. 11, on only one of the uprights. The bottom insert member 24 is thus held axially between tubular members 18 of the bottom shelf floor section 12 and the bearing housing of roller 14. At the bottom end of the adjacent upright 10, tapered end 20 of its bottom segment 16 is in screw connection with a nut 26, which, next to the bearing housing of roller 14, axially holds the bottom insert 24 which is in the shape of a pair of spectacles. The thickness of the spectacle-like inserts 24 is determined by measurement of the lenghts of tubular members 18, tapered ends 20 and the inside threading 22.

Instead of the two uprights which are connected by means of members 24 in the shape of spectacles, it is possible, as shown in FIG. 11B, that only one single vertical upright 10 will suffice for each joint A and B, of which the middle lengthwise axis then forms the pivot axis, around which the relevant side part R2 or R3 is pivoted relative to middle part R1. As shown in FIG. 11B, for this purpose tubular member 18 is in displaced or shifted configuration in relation to the middle of shelf floor section 12 and is connected tightly with said shelf floor section 12, for instance welded thereto, in such a manner that the one contact surface of a tubular member 18 is located on the horizontal middle plane of a shelf floor section 12'. If the shelf floor section belongs to the other shelf part, bordering said part, which is indicated with 12'' in FIG. 11B, arranged with the top surface facing downward, and the tubular member 18'' mounted on it is supported on the first selected tubular member 18', then both shelf floor sections 12' and 12'' lie at the same level when in assembled state. The tapered end 20 of a top segment 16' of the single upright 10 extends through both tubular members 18' and 18'' and is screwed together with an inside thread in a bottom segment 16'' of the upright.

Figure 12:
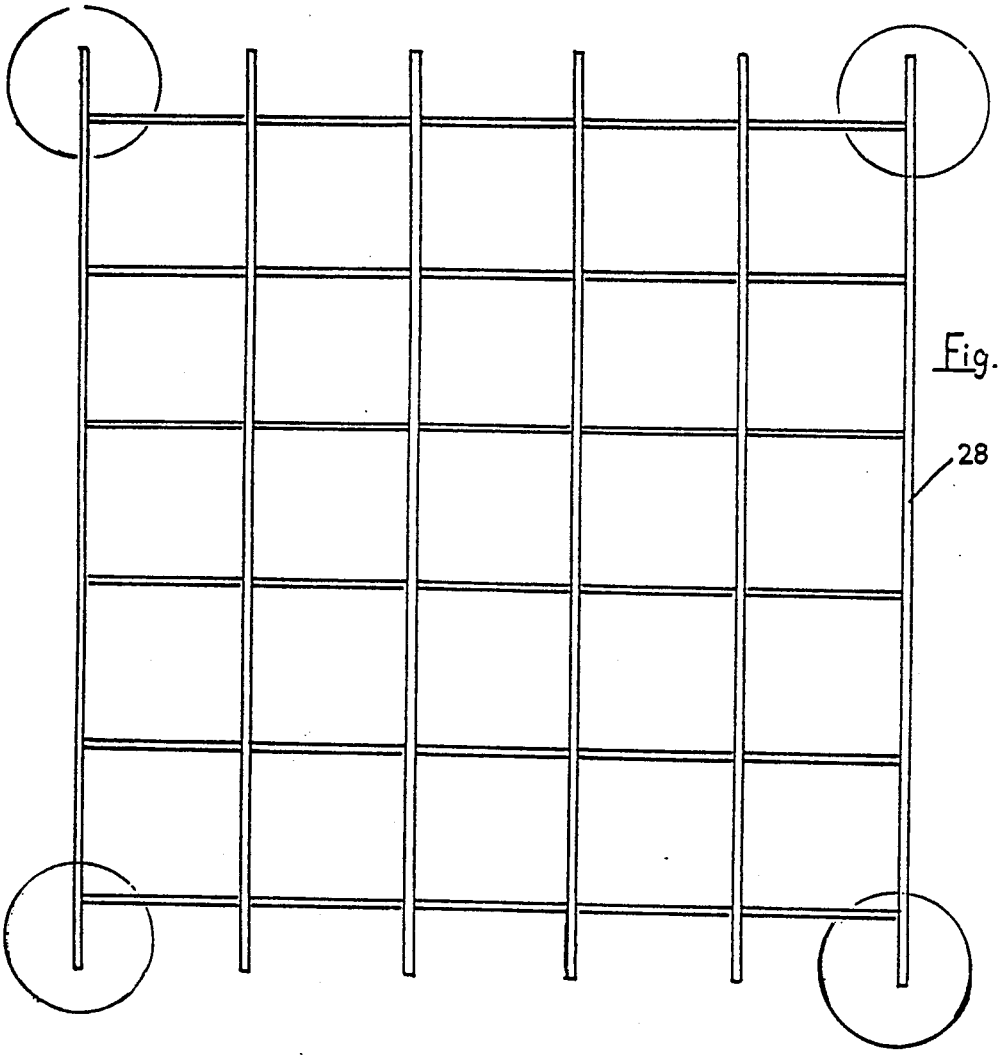
FIG. 12 shows a side view of a wire grating which serves as rear or side wall of the shelf.
Figure 12A:
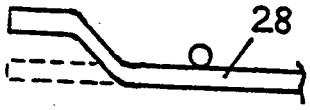
FIG. 12A shows a transverse view of the corners of the wire grating of FIG. 12 in larger scale.

The floor sections of the described shelf could for instance be of metal, glass, wire-reinforced glass, plastic or treated wood. In case side or rear walls are to be mounted on the shelf between the shelf floor sections, preferably a wire screen 28 is provided for this purpose, as shown in FIG. 12. For instance it can be exactly of such dimensions that its width coincides with the lenght of a cathetus of the outline or basic plan of side parts R2, R3, while its height corresponds with that of the vertical intermediate space of the shelf floor section 12. Wire screen 28 can thus be simply fastened therein, in that all of the vertical wires of screen 28 project upward over the top horizontal wire and downward over the bottom wires, but only two vertical wires, preferably the outermost wires, are offset at their top and bottom ends as shown in FIG. 12A. With the different arrangements of wire screen 28, the top ends of the vertical wires which are aligned differently could surround a wire extending at the level of a shelf floor section 12 along its rear or side edge—for instance the edge wire of a shelf floor section likewise consisting of wire screen—on both sides, and in a corresponding manner, following this hook-fastening, then the top wire ends of screen 28 could be applied to the edge of a shelf floor section by lowering wire screen 28 and also the bottom wire ends could be brought into contact with a horizontal edge wire of the next bottom shelf floor section, and the upward projecting wire ends of wire screen 28 are to be measured to such a length that they too still remain in engagement with the top shelf floor section, when the offset bottom wire ends of wire screen 28 are placed on and affixed to the edge wire of the bottom shelf floor section. Of course it would also be possible to provide plate-like shelf floor sections which, instead of only an edge wire, also have apertures at the edge, into which can be inserted a portion of the top and bottom wire ends of the wire screen 28.

It is to be understood that the material, the form and the type of connection arrangement of the individual parts described above could also be selected other than as in the specially featured exemplary embodiments, in order to adapt the shelf according to the invention in any individual case for a certain purpose.

What is claimed is:

1. A multi-part shelf comprising:

a unitary middle part (R1) and two side parts (R2, R3), each of said parts having a plan outline in the form of an equilateral right triangle whereby each said part has a hypotenuse side and two cathetus sides and whereby an outline area of said middle part is twice an outline area of said side part, each of said parts including a plurality of superposed triangular shelf floor sections having three corners and a plurality of elongate uprights structurally connecting adjacent said floor sections at each of said three corners; and a respective articulation connection means (A, B) provided between said middle part and each respective said side part for pivotally connecting said parts such that said side parts are individually pivotable between a configuration where one said cathetus side of said side part is immediately adjacent said hypotenuse side of said middle part and a configuration where said hypotenuse side of said side part is immediately adjacent one said cathetus side of said middle part.

2. A multi-part shelf as claimed in claim 1 and further including a pivoting roller at a bottom of each said corner of a lowermost said floor section of each said part.

3. A multi-part shelf as claimed in claim 1 wherein said floor sections are suspended between adjacent said uprights.

4. A multi-part shelf as claimed in claim 1 and further including walls which are attachable between adjacent edges of adjacent floor sections of said parts.

5. A multi-part shelf as claimed in claim 1 wherein said floor sections of said middle part are comprised of two half sections having the same size as said floor sections of said side parts.

6. A multi-part shelf as claimed in claim 1 wherein said part includes a separate upright at the corners thereof; and wherein said articulation connection means includes an insert member including two apertures, each respective said aperture receiving therethrough a respective said upright.

7. A multi-part shelf as claimed in claim 1 and further including detachably mounted walls provided between said floor sections of said side parts along said cathetus sides.

8. A multi-part shelf as claimed in claim 1 wherein each said floor section includes an aperture at said corners; and wherein each said upright is comprised of a plurality of elongate segments which are fitted together at each said floor section, each said segment having a support end provided with a support surface and an insert end which is received in said support end of an adjacent said segment such that said floor section is supported by said support surface and an insert end of an adjacent said segment is received in said aperture of said floor section until said insert end connects with the adjacent said support end.

9. A multi-part shelf as claimed in claim 8 wherein a single upright structurally connects adjacent said floor sections of said middle part and said side part and supports both said floor sections of said middle part and the associated said side part.

10. A multi-part shelf as claimed in claim 9 wherein said apertures are provided in a tubular member attached to the associated said floor section, and said tubular members of one of said middle part and said side part being located below a middle of the associated said floor section while said tubular member of the other are located above a middle of the associated said floor section whereby adjacent said floor sections of said middle part and said side part are coplanar.

* * * * *